United States Patent [19]

Widmer

[11] 4,184,429

[45] Jan. 22, 1980

[54] CONSTANT BEVEL DOCTOR BLADE AND METHOD AND APPARATUS USING SAME

[75] Inventor: Max Widmer, Zofingen, Switzerland

[73] Assignee: Max Datwyler & Co., Bleienbach, Switzerland

[21] Appl. No.: 653,429

[22] Filed: Jan. 29, 1976

Related U.S. Application Data

[63] Continuation-in-part of Ser. No. 514,485, Oct. 15, 1974, abandoned, which is a continuation-in-part of Ser. No. 329,070, Feb. 2, 1973, abandoned.

[30] Foreign Application Priority Data

Feb. 9, 1972 [CH] Switzerland ..... 1831/72

[51] Int. Cl.[2] ..... B41F 9/10

[52] U.S. Cl. ..... 101/169; 101/365

[58] Field of Search ..... 101/157, 169, 365, 350; 118/261; 30/346.55

[56] References Cited

U.S. PATENT DOCUMENTS

| | | | |
|---|---|---|---|
| 447,126 | 2/1891 | Archer | 101/169 |
| 1,092,798 | 4/1914 | Nuttall | 101/169 X |
| 1,812,920 | 7/1931 | Ballard | 101/157 |
| 1,881,334 | 10/1932 | Treiber | 30/346.55 X |
| 1,918,856 | 7/1933 | Merrick | 30/346.6 |
| 2,022,635 | 11/1935 | Durham | 101/157 |
| 2,052,679 | 9/1936 | Wainwright et al. | 101/169 |
| 2,148,456 | 2/1939 | Grossarth | 101/169 |
| 2,361,554 | 10/1944 | Lundbye | 101/169 X |
| 2,638,844 | 5/1953 | Halley | 101/169 |
| 3,006,275 | 10/1961 | Allen | 101/157 |
| 3,026,796 | 3/1962 | Crawford | 101/157 |
| 3,514,856 | 6/1970 | Camp et al. | 30/346.55 X |
| 3,623,965 | 11/1971 | Owren | 101/157 X |

FOREIGN PATENT DOCUMENTS

| | | | |
|---|---|---|---|
| 1053530 | 3/1959 | Fed. Rep. of Germany | 101/169 |
| 1262393 | 4/1961 | France | 101/169 |
| 26628 | of 1897 | United Kingdom | 101/169 |

*Primary Examiner*—J. Reed Fisher

*Attorney, Agent, or Firm*—Benoit Law Corporation

[57] ABSTRACT

A doctor blade for wiping excess ink from a printing surface of a printing form is disclosed herein, along with a method for making such a doctor blade, and printing equipment and methods using such doctor blade. The disclosed doctor blade comprises a doctor blade body having a constant blade thickness between parallel blade surfaces, and a marginal blade tip portion adjacent the doctor blade body having a shaped blade bevel essentially identical to the run-in blade bevel of a wedge-shaped conventional blade at optimum tonal quality size. Throughout a useful depth of its blade tip portion, the disclosed doctor blade has a constant blade tip thickness equal to the height of the shaped blade bevel measured essentially perpendicularly to the mentioned useful depth, which is equal to several times the shaped blade bevel height. In consequence, the effective area of the shaped blade bevel remains constantly at the above mentioned optimum size despite progressive wear of marginal blade tip portion in the direction of and throughout the useful depth during the excess ink wiping operation.

37 Claims, 7 Drawing Figures

ADVANCE
INK
116
115
1
2
3
4
7
8
9
10
11
12
13
14

CONSTANT BEVEL DOCTOR BLADE AND METHOD AND APPARATUS USING SAME

CROSS-REFERENCE

This is a continuation-in-part application of the commonly assigned patent application Ser. No. 514,485, filed Oct. 15, 1974, for Doctor Blade for Photogravure Printing Machine, now abandoned, which, in turn, was a continuation-in-part application of the commonly assigned patent application Ser. No. 329,070, filed Feb. 2, 1973, for Doctor Blade for Photogravure Printing Machine, now abandoned.

The benefit of the earlier filing data under 35 USC 119 of Swiss Patent Application No. 1831/72, filed on Feb. 9, 1972, by the assignee of the entire interest is claimed for this continuation-in-part patent application and any patent issuing or reissuing therefrom.

BACKGROUND OF THE INVENTION

1. Field of the Invention

The subject invention relates to printing methods and apparatus and to doctor blades and methods for making doctor blades for wiping excess ink from a printing surface of a printing form, especially in photogravure printing.

2. Description of the Prior Art

It is well known that with the different photogravure printing techniques which are employed in the printing art, the ink or dye, which adheres to the etched or engraved wells or depressions of different volume of the flat or cylindrically shaped printing form, is applied under mechanical pressure to the material to be imprinted. The wells or depressions are filled with printing ink and the excess ink is removed by a doctor blade.

With present conventional constructions of rotary photogravure printing machines, also known as rotogravure printing machines, wherein the printing form is a rotating cylinder, there is employed a doctor blade which consists of resilient material. This doctor blade is clamped into a doctor blade holder and extends in the direction of the axis of the rotating printing cylinder. The arrangement is such that the wedge-shaped constructed free end of the doctor blade comes into contact with the rotating cylinder.

The flattened tip of the doctor blade, also known as the doctor blade bevel, which is in contact with the cylinder, insures the removal of the excess ink and is subject to continuous wear. This wear causes an increase in the width of the bevel at the tip of the doctor blade owing to removal of material at the contact region. Due to the increase of the bevel width there occurs tonal increases which constitute some of the most undesirable phenomena.

A width of about 100 μm is about the upper permissible limit of the bevel width. Hence the printer oftentimes must have the doctor blade exchanged after about forty thousand revolutions of the cylinder. This in turn results in frequent downtime of the equipment, and additionally the formation of mackled sheets when placing the machine or equipment again into operation.

The prior art has not been able to overcome these disadvantages and drawbacks, despite a wealth of proposals in the doctor blade art and related fields.

For instance, some known doctor blade designs are of such complexity as to be of little practical value, not only because of extremely high manufacturing costs and complexities, but also because of the presentation of discontinuous or irregular scraping surfaces which bring about streaks and other visible defects in the printed work.

Even with straight edged doctor blades, there always has been a problem of sorts in view of the fact that a very thin blade is difficult to apply evenly across the entire, typically rather long cylinder, and will wear rapidly, while a thick blade would not be supple and flexible enough for some applications.

For instance, an early proposal attempted to improve the wear characteristics of the active front edge, while retaining the suppleness of the overall blade, by providing a doctor blade with a thick front portion as compared to a relatively thin main body of the blade. For a similar effect another proposal provided one or more grooves in the blade body. Another prior-art approach mounted the doctor blade between two spaced plates which left a hollow space between the blade and its holder. The handling of such blades was cumbersome and they were difficult and expensive to manufacture.

In consequence, the continuous or constant thickness doctor blade became and remained the most widely used excess ink wiping means in the printing art under consideration. Where the dimensioning of the doctor blade thickness approached razor blade proportions, a complex backing blade structure, or bulky electromagnetic equipment, or other types of reinforcement was frequently necessary in an endeavor to provide a uniform application of the doctor blade to the associated cylinder.

This generally discouraged a "razor blade approach" to the doctor blade art, inasmuch as the removal of facial hair involves objectives and environments that are alien to the intaglio and photogravure printing art and its requirements. As an exception, one could mention a prior art type of doctor blade which, in a sense, resembles a very modern type of razor blade characterized by a uniform blade thickness having an inclined wedge surface. However, that is where the comparison ends, since doctor blades of the latter type had to be provided with a run-in blade bevel having an optimum size for an achievement of the best printing quality. This led to the above mentioned disadvantages including an increasing deterioration of tonal quality as a function of blade wear.

Tired of high expense and bother entailed by the rapid blade bevel wear of the conventional wedge-tip doctor blade, many printers have resigned themselves to not even attempting to form and maintain a blade bevel at the inclined wedge surface. Instead, they simply turn the doctor blade by 180° about its longitudinal axis and use the wedge surface itself to wipe excess ink from the printing surface. Other printers do this out of a similar frustation when the blade bevel has become worn. The result is the horrible color prints one can see in the magazine portions of many Sunday papers and in sundry other widely disseminated pictorial materials.

SUMMARY OF THE INVENTION

It is a primary object of the present invention to avoid and overcome the above mentioned drawbacks and disadvantages and to provide new and improved doctor blades for photogravure printing machines and similar applications, providing maintenance of an essentially uniform tonal print quality throughout extended blade wear.

It is a related object of the invention to provide improved printing methods and equipment characterized by reduced downtime and increased uniform print quality.

Another object of this invention is to provide new and improved methods of making a doctor blade for wiping excess ink from a printing surface of a printing form.

Broadly speaking, both the approach and the execution of the subject invention are characterized by a structuring of the doctor blade within the general outline of the most widely used conventional doctor blade having the above mentioned wedge-shaped tip portion including a run-in blade bevel of an optimum tonal quality size. According to the subject invention, this structuring is effected within the latter outline in such a manner that the run-in blade bevel of optimum tonal quality size is maintained intact through progressive wear of the blade tip portion.

I am aware, in this connection, of the stepped configuration of the blade shown in German Patent Publication No. 1,053,530, filed July 27, 1956, by Schnellpressenfabrik Koenig & Bauer Aktiengesellschaft (Gregor Muth, Inventor), However, that stepped configuration is coincidental to a mounting and actuation of a blade which, while providing an adjustable gap at a doctor roller, never touches any printing cylinder to be exposed to any wear thereby. No recognition of the approach, value or utility of the subject invention, of of its implementation in any manner, is apparent from that German patent application.

From one aspect thereof, the subject invention resides in a printing method of a type wherein excess ink is wiped from the printing surface of a printing form with a doctor blade having conventionally a given constant blade thickness between two mutually parallel blade surfaces and a generally wedge-shaped tip portion including a run-in blade bevel having an optimum tonal quality size and extending from one of the blade surfaces at an angle corresponding to an angle of attack of the doctor blade relative to the printing surface, and an inclined wedge surface extending from that blade bevel to the other of the blade surfaces, whereby the effective area of the blade bevel would increase from the optimum size through progressive wear of the tip portion during use of the blade to sizes eventuating in progressive degradation of print quality.

The invention, according to this aspect thereof, resides in the improvement comprising in combination the steps of preparing a second doctor blade for use in lieu of the above mentioned conventional doctor blade by providing a doctor blade blank having said blade thickness between said parallel blade surfaces, shaping a marginal portion of said blank into a second blade tip portion, providing said second blade tip portion with a second blade bevel essentially identical to said run-in blade bevel having said optimum tonal quality size and providing said second blade tip portion throughout a useful depth of said second blade tip portion with a constant second blade tip thickness equal to the height of said second blade bevel measured essentially perpendicularly to said useful depth, with said useful depth being made equal to several times said second blade bevel height, whereby the effective area of said second blade bevel remains constantly at said optimum size through progressive wear of said second blade tip portion in the direction of and throughout its useful depth, applying said second doctor blade to said printing surface at an angle essentially equal to said angle of attack, with said second blade bevel being in contact with said printing form, applying said ink to said printing surface and printing form, effecting relative movement between said printing form and second doctor blade whereby said second blade tip portion is caused to wipe excess ink from the printing surface at said optimum size second blade bevel, and continuing said excess ink wiping by continuing said relative movement and advancing said second doctor blade toward said printing form to compensate for wear of said second blade tip portion and to maintain said second doctor blade continuously in contact with said printing form via a second blade bevel maintaining continuously said optimum size throughout said useful depth of said second blade tip portion.

From another aspect thereof, the invention resides in a method of making a doctor blade for wiping excess ink from a printing surface of a printing form in lieu of a conventional doctor blade of the above mentioned configuration. The invention according to this aspect resides in the improvement comprising in combination the steps of providing a doctor blade blank having said blade thickness between said parallel blade surfaces, shaping a marginal portion of said blank into a blade tip portion, providing the latter blade tip portion with a shaped blade bevel essentially identical to said run-in blade bevel having said optimum tonal quality size and providing the latter blade tip portion throughout a useful depth of said latter blade tip portion with a constant blade tip thickness equal to the height of said shaped blade bevel measured essentially perpendicularly to said useful depth, with said useful depth being made equal to several times said shaped blade bevel height whereby the effective area of said shaped blade bevel remains constantly at said optimum size despite progressive wear of said shaped blade tip portion in the direction of and throughout said useful depth during said excess ink wiping.

From another aspect thereof, the invention resides in a doctor blade made by the latter method.

Similarly, the invention also resides in a doctor blade for wiping excess ink from a printing surface of a printing form in lieu of a conventional doctor blade of the above mentioned type. The invention according to this aspect resides, more specifically, in the improvement comprising, in combination, a doctor blade body having said blade thickness between said parallel blade surfaces, and a marginal blade tip portion adjacent said doctor blade body having a shaped blade bevel essentially identical to said run-in blade bevel with said optimum tonal quality size, and having throughout a useful depth of the latter blade tip portion a constant blade tip thickness equal to the height of said shaped blade bevel measured essentially perpendicularly to said useful depth, with said useful depth being made equal to several times said shaped blade bevel height, whereby the effective area of said shaped blade bevel remains constantly at said optimum size despite progressive wear of said marginal blade tip portion in the direction of and throughout said useful depth during said excess ink wiping.

The subject invention resides also in a printing apparatus of a type wherein excess ink is wiped from the printing surfaces of a printing form with a doctor blade having the above mentioned conventional configuration. The invention according to this aspect resides, more specifically, in the improvement comprising in combination a marginally shaped doctor blade in lieu of said conventional doctor blade, including a doctor blade body having said blade thickness between said parallel blade surfaces, and a marginal blade tip portion adjacent said doctor blade body having a shaped blade bevel essentially identical to said run-in blade bevel with said optimum tonal quality size, and having throughout a useful depth of the latter blade tip portion a constant blade tip thickness equal to the height of said shaped blade bevel measured essentially perpendicularly to said useful depth, with said useful depth being made equal to several times said shaped blade bevel height, whereby the effective area of said second blade bevel remains constantly at said optimum size despite progressive wear of said marginal blade tip portion in the direction of and throughout said useful depth, means operatively associated with said marginally shaped doctor blade for applying said marginally shaped doctor blade to said printing surface at an angle essentially equal to said angle of attack and placing said shaped blade bevel into contact with said printing form, means operatively associated with said printing form for applying said ink to said printing surface and printing form, means operatively associated with said printing form for effecting relative movement between said printing form and said marginally shaped doctor blade whereby said marginal blade tip portion is caused to wipe excess ink from the printing surface at said optimum size shaped blade bevel, and means operatively associated with said blade applying means for advancing said marginally shaped doctor blade toward said printing form to compensate for wear of said marginal blade tip portion and to maintain said marginally shaped doctor blade continuously in contact with said printing form via a shaped blade bevel maintaining continuously said optimum size throughout said useful depth of said marginal blade tip portion.

BRIEF DESCRIPTION OF THE DRAWINGS

The invention and its objects will become more readily apparent from the following detailed description of preferred embodiments thereof, illustrated by way of example in the accompanying drawings, wherein like reference numerals designate like or equivalent parts, and wherein.

DESCRIPTION OF PREFERRED EMBODIMENTS

Figure 3:
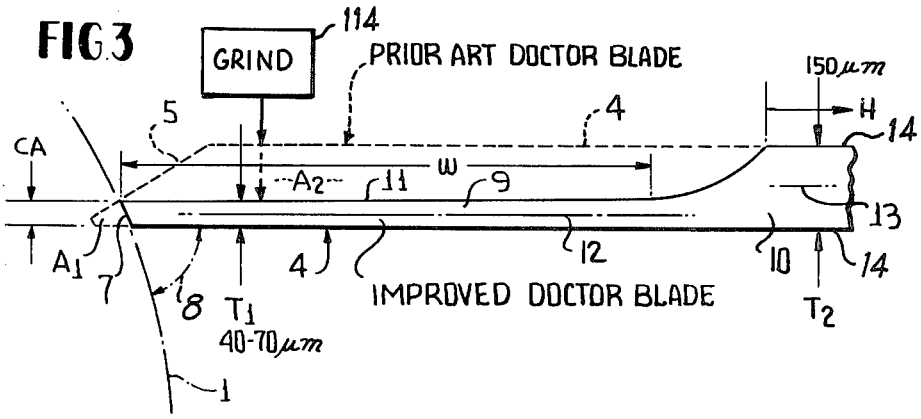
FIG. 3 is a composite or overlay view of the construction of known prior art doctor blades as compared to the doctor blade of the present invention.
Figure 4:
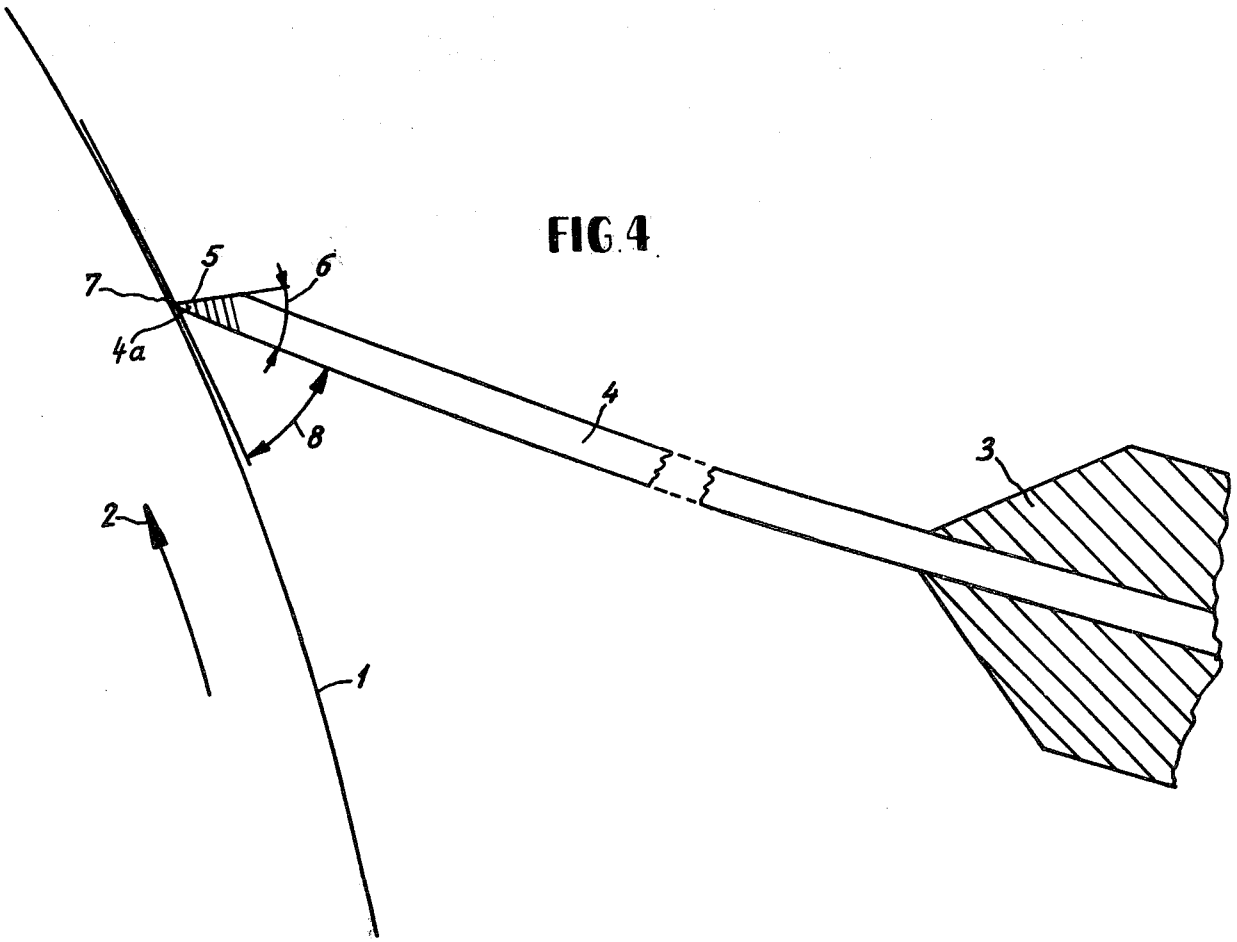
FIG. 4 is a schematic fragmentary view of a photogravure printing machine incorporating a printing cylinder, a doctor blade of the type conventionally employed at the present time and a doctor blade holder.

Reference is now made to the drawings, particularly FIG. 4, depicting a portion of a presently conventional photogravure printing machine with a printing surface in the form of a cylinder 1 rotating in the direction generally indicated by the headed arrow 2. A conventional doctor blade 4 is provided for the cylinder 1 and such is clamped in a doctor blade holder or support 3. The conventional doctor blade 4 corresponds to the like doctor blade 4 indicated in dashed lines in FIG. 3. The doctor blade 4 possesses conventionally a given constant blade thickness amounting to approximately 150 μm between two mutually parallel blade surfaces 14, 14 over its entire length, excluding the decreasing thickness of the conventional ground, generally wedge-shaped doctor blade tip portion 5. The tip or end 5 of the doctor blade 4 which contacts or engages the printing cylinder 1 is initially pointed, as is indicated by the reference numeral 16 in FIG. 1. The wedge angle, designated by the reference numeral 6 in FIG. 4, generally is approximately 32°. A tip 4*a* (FIG. 4) of the doctor blade 4 is flattened by conventional running-in techniques so as to be approximately parallel to the printing cylinder 1 in order to form a contact surface between the printing cylinder 1 and the doctor blade 4. The width or area of the tip 4*a* is generally termed the doctor blade bevel 7, and at the start of the printing operation is approximately 20 μm. Also conventional is the so-called blade angle 8 (FIG. 4) which is the angle of attack of the doctor blade 4 relative to the periphery of the cylinder 1 which, though typically an acute angle, can have values up to approximately 90°. As apparent from FIG. 3, the blade bevel 7 extends from one of the blade surfaces 14 at an angle corresponding to the angle of attack 8 relative to the printing surface of the cylinder 1. In a run-in blade, the wedge-shaped tip portion has an inclined wedge surface at 5 (see dotted outline in FIG. 3) extending from the blade bevel 7 to the other of the blade surfaces 14. From a comparison of FIGS. 1 and 4 it will be apparent that initially the tip 16 must be run-in to a degree at which the run-in tip 4*a* is of a width or area sufficient to obtain desired tonal characteristics. In other words, the run-in blade bevel has an optimum tonal quality size.

Figure 1:
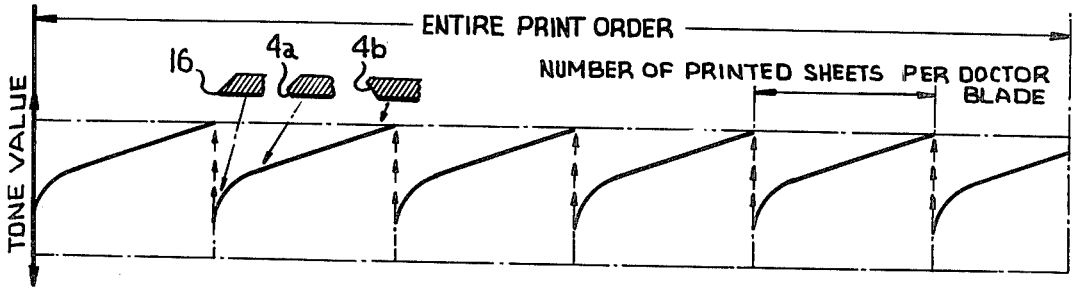
FIG. 1 (PRIOR ART)
FIG. 1 is a chart directed to the run-in and wear characteristics of a prior art doctor blade, and illustrates graphically the variance in tone value over a predetermined period of successive conventional doctor blade usages.

However, as the tip 4*a* progressively wears its width or area increases to the extent that ink can no longer be satisfactory wiped away from the cylinder 1, with the optimum area reaching a point at which the doctor blade is virtually rendered inoperative because of the increased size of the tip, as indicated at 4*b* in FIG. 1. The tip 4*b* is generally of a width of approximately 100 μm, and at this point tonal value decreases to an unsatisfactory point for high-quality printing. At this point, the printing machine must be shut down for the purpose of exchanging the worn doctor blade for another doctor blade or regrounding the worn doctor blade with the tip 4*b* to the configuration of the pointed tip 16 of FIG. 1. Obviously, when the printing machine is again placed in operation there are initially produced unusable or rejected printed products before the printing operation can be satisfactorily resumed because the pointed tip 16 must be run-in to achieve the tip configuration 4*a* of FIG. 1. Thus, as between the initial configuration of the pointed tip 16 and the tip 4*a* there is a loss in printing stock, not to mention downtime in changing conventional doctor blades and/or regrinding a worn doctor blade (4*b*) and reinstalling such doctor blade into the printing machine for another run.

Figure 2:
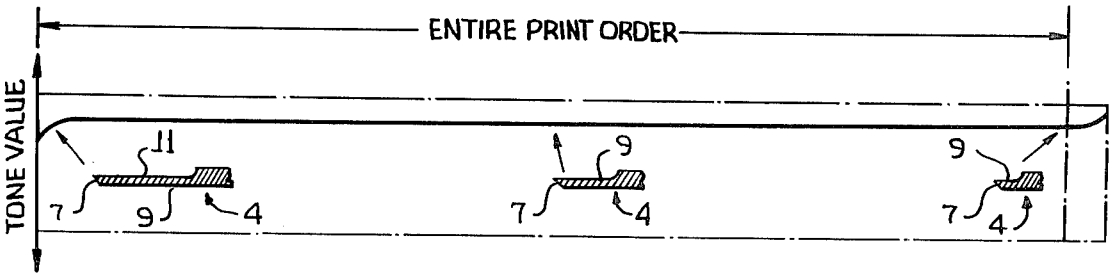
FIG. 2 is a chart which illustrates the doctor blade of the present invention, and likewise indicates graphically the superiority of usage of the present doctor blade as compared with the prior art, as exemplified by the chart of FIG. 1.
Figures 5, 6, 7:
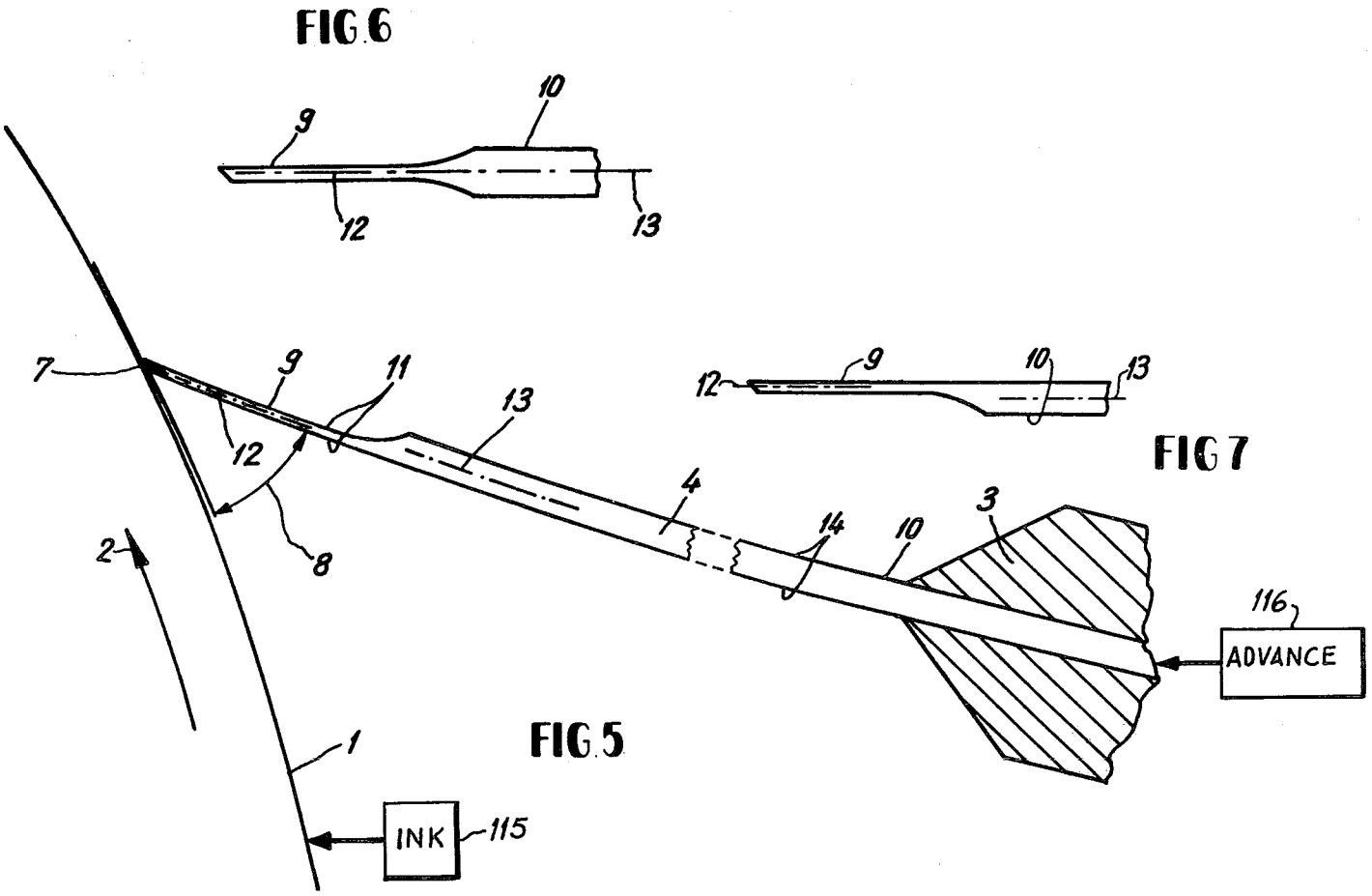
FIG. 5 is a schematic fragmentary view of a photogravure printing machine equipped with a first exemplary embodiment of a doctor blade designed according to the teachings of the present invention.
FIG. 6 is a fragmentary cross-sectional view through the end of a second embodiment of another doctor blade of this invention.
FIG. 7 is a cross-sectional view of another embodiment of doctor blade of this invention intended to come into contact with the printing cylinder.

Reference is now made to FIGS. 2 and 5 of the drawings which illustrate in the latter a photogravure printing machine equipped with a doctor blade 4 constructed according to the present invention. In FIG. 5 the direction of rotation of the printing cylinder 1 is indicated by the headed arrow 2 and the arrangement of the doctor blade 4 in a holder 3 along with the blade angle 8 corresponds to the conventional arrangement illustrated in FIG. 4. Ink is applied to the printing surface of the printing form cylinder 1 in a conventional manner, symbolized by the block 115 in FIG. 5.

With the preferred embodiment of the doctor blade 4 (FIG. 5) of this invention, the doctor blade 4 is provided at the end thereof confronting the printing cylinder 1 with a first thin flexible terminal forward end section 9 defined between two parallel surfaces 11. This may be done by grinding as indicated by the block 114 in FIG. 3. The length of the section 9 is approximately 1,000 μm and its thickness T1 is approximately 50 μm, although it is to be understood that these dimensions can differ and are merely exemplary of optimum dimensions to maintain desired tonal quality. The thickness T2 of a remaining rearward mounting section 10 is equal to the conventional thickness of the conventional doctor blade 4 of FIG. 4 and amounts to generally 150 μm. In keeping with the present invention the tip 7 (FIGS. 2 and 5) is bevelled approximately parallel to the printing cylinder 1 and defines a doctor blade tip or bevel 7 of approximately 70 μm.

By referring to FIGS. 2 and 5 it is readily apparent that when the surfaces 11 of the doctor blade 4 are parallel to one another, increasing wear of the doctor blade tip 7 does not increase the bevel or tip width, as occurs in the conventional doctor blade of FIGS. 1 and 4, noting particularly the point 16, the bevel 4*a*, and the bevel 4*b* of FIG. 1. Rather, the tip or bevel 7 of the present doctor blade 4 (FIGS. 2 and 5) remains at a generally constant value of, for example, 70 μm for such time until the entire length of the forward flexible section 9 has been worn to a point of disuse, as indicated in the right-end most illustration in FIG. 2. Consequently, there does not occur the previously mentioned undesired increase in tone which occurs after the conventional doctor blade tip 4*b* reaches the configuration shown in FIG. 1 necessitating a shutdown of the machine for the purposes of exchanging the doctor blade due to the excessively large bevel width or tip width.

The doctor blade of this invention shown in FIG. 5 and in solid outline in FIG. 3 further includes an axis 12 of symmetry in the section 9 at the mid portion thereof which is offset from a like axis 13 of symmetry of the section 10 which is likewise disposed intermediately of the latter. In accordance with the preferred embodiment illustrated in FIGS. 3 and 5, the blade tip portion 9 has a surface 11 in a plane with one of the parallel blade surfaces 14.

Reference is now made to a comparison of FIGS. 1 and 2, and particularly the disadvantages of known conventional doctor blades (FIG. 1). Essentially problems arise along with costs incident thereto in conventional doctor blades due to such factors as downtime when printing machines have to be stopped for the replacement of doctor blades (upon wear of conventional doctor blades to or beyond the configuration of the tip 4*b* of FIG. 1), wastage of material because paper is wasted each time the printing machine is started after replacement of a doctor blade, additional wastage of work due to required adjustment of the doctor blade to achieve desired tone values from the initial ground configuration including the sharp tip 16 and the run-in contact edge 4*a*, the necessity of providing new doctor blades when proofing a new cylinder, the expense of doctor blade grinding as each doctor blade is worn to a point (4*b*) at which it is virtually inoperative due to its failure to achieve desired tone values, and difficulties in grinding an even edge across the length of a standard doctor blade which might be, for example, of a length on the order of 100 inches. These problems are graphically indicated in the chart of FIG. 1 wherein over a predetermined time period six conventional doctor blades of the type shown in FIGS. 1 and 4, or a single such doctor blade reground five times, are employed to print a given print order of a size requiring a change of conventional doctor blades, or a regrinding of a conventional doctor blade, for at least five times. In practice it has been found that conventional doctor blades wear out beyond their useful life at approximately 40,000 to 50,000 revolutions of the printing cylinder in the case of high-quality printing. In keeping with the present invention it has been found that a doctor blade constructed in accordance with the preferred embodiment of the invention heretofore described relative to FIGS. 2 and 5 will last up to ten times longer than the conventional doctor blade due to the continued constant contact area or optimum blade bevel 7 (FIGS. 2 and 5) of the doctor blade, with the only change necessitated is that of advancing the doctor blade toward the printing cylinder as it wears. Moreover, since the contact area or tip 7, in accordance with a preferred embodiment of the subject invention, is ground with generally the correct contact angle relative to the cylinder 1 in correspondence to the angle of attack 8, substantial perfect doctoring is achieved from the very beginning of any printing cycle and therefore extensive run-in is unnecessary and no change in tone value appears due to wear of the doctor blade. Thus disadvantages inherent in the prior art doctor blades are totally avoided during the entire life of the doctor blade 4 of this invention until the useful depth ω of the blade tip portion 9 has been worn off (see FIGS. 2 and 5).

The doctor blade 4 of this invention (FIG. 5) is manufactured from standard spring steel of an approximate thickness of 150 μm, as was noted heretofore, which provides a doctor blade blank having the blade thickness of a conventional doctor blade between the blade surfaces 14, 14 of the conventional doctor blade. In the doctor blade of the subject invention, the latter thickness is that of the rearward section 10 between the parallel surfaces 14, 14. However, to achieve the narrower forward section 9 a marginal portion of the blank is ground across at least its upper surface 14, as indicated in FIG. 5 by the block 114, to a condition of parallelism between the surfaces 11, 11, with the upper surface 11 being the ground surface, resulting in a blade tip portion 9 having throughout a useful depth ω a constant blade tip thickness T1 equal to the height of the blade bevel 7 measured essentially perpendicularly to that useful depth ω or, in other words, measured between the surfaces 11, 11. FIG. 3 is illustrative of the manner in which a generally standard or conventional doctor blade 4, shown in phantom outline or dashed lines, is ground to form the upper ground surface 11 as well as the ground blade tip portion 7 which is essentially identical to the run-in blade bevel having the optimum tonal quality size. Thus the two areas outlined by the dashed lines and the outer perimeter of the doctor blade of this invention represent areas A1, A2 of material removed from the standard or conventional doctor blade. It is thus seen that the doctor blade of this invention is made from or comprises one piece of solid material as seen in FIGS. 2, 3 and 6 to 7.

Reference is now made to FIG. 3 wherein dimensionally is indicated the standard doctor blade thickness T2 of approximately 150 μm which defines the rearward mounting section of the improved doctor blade 4. The dimension H is the distance between (a) the beginning of the thickest portion T2 of the doctor blade 4 adjacent the thin terminal forward section 9 and (b) the doctor blade holder 3 (FIG. 5) or, in other words, the depth of the portion of the doctor blade having the blade thickness T2 between the parallel blade surfaces 4, 4 and being located outside the doctor blade holder and adjacent the second blade tip portion. In accordance with a preferred embodiment of the subject invention, H is less than 5.6 times the useful depth ω of the blade tip portion 9. By way of example, a practical value of H is between 4 to 5 millimeters. The useful depth ω of the flexible blade tip portion or terminal forward section 9 of the doctor blade is made equal to several times the height of the blade bevel 7, that is, the thickness of the blade tip portion between the surfaces 11, 11 and, in accordance with a preferred embodiment, is approximately one millimeter at a tolerance of plus or minus ten percent, while the thickness T1 or CA of the section 9 ranges between 40–70 μm, with 50 μm being an average. In practice, the thickness T1 of the section 9 is finished at a tolerance of plus or minus 0.005 millimeters. The distance between the parallel surface 11, 11 measured along the surface of the bevel 7 (i.e. the bevel width) is approximately 60–80 μm, and the angle between the periphery of the cylinder 1 and the section 9 of the blade 4 is approximately 60°.

The fact that the blade 4 is made of an integral one-piece of spring steel limits the deflection of the doctor blade to workable values, even though the thickness of the section 9 is approximately only that of a human hair.

In particular, the doctor blade according to the illustrated preferred embodiment of the invention is applied to the printing surface at an angle essentially equal to the angle of attack 8, with the blade bevel 7 being in contact with the printing form. Ink is applied to the printing surface and printing form as indicated in FIG. 5 at 115. The printing cylinder 1 is moved relatively to the improved doctor blade as indicated by the arrow 2 whereby the doctor blade is caused to wipe excess ink from the printing surface at the optimum size blade bevel 7. This excess ink wiping operation is continued during execution of the printing job by continuing the relative movement indicated by the arrow 2 and advancing the doctor blade toward the printing form or cylinder 1 in a conventional manner and by conventional blade advance equipment indicated at 116 in FIG. 5 to compensate for wear of the blade tip portion 9 and to maintain the doctor blade continuously in contact with the printing form or cylinder via a blade bevel which maintains continuously the optimum tonal quality size of the bevel 7 throughout the useful depth ω of the blade tip portion 9.

Reference is now made to FIG. 6 which illustrates another embodiment of a doctor blade constructed in accordance with this invention in which the axes of symmetry 12 and 13 of the cross-sections of both the flexible terminal forward section 9 and the more rigid rearward mounting section 10 are coincident with each other. The dimensioning of the sections 9 and 10 corresponds identically to those described relative to FIG. 3, except that in keeping with the embodiment of the invention shown in FIG. 6 the section 9 is ground at both upper and lower surfaces to a depth symmetrical to the coincident axes 12, 13, whereby the blade tip portion 9 and the remainder of the doctor blade or doctor blade blank have a common longitudinal plane of symmetry.

In FIG. 7 of the drawings another embodiment of the invention is illustrated which is identical to that of FIG. 5 in which the axes 12, 13 of the sections 9, 10 are offset relative to each other, but in this case the tip or contact area 12 is ground inverse to the angle of the tip 7 of the blade 4 of FIG. 5, as is readily apparent from a comparison of these two figures (FIGS. 5 and 7).

While there are shown and described presently preferred embodiments of the invention, it is to be distinctly understood that the invention is not limited thereto, but may be otherwise variously embodied and practiced within the scope of the following claims:

I claim:

1. In a printing method of a type wherein excess ink is wiped from the printing surface of a printing form with a doctor blade having conventionally a given constant blade thickness between two mutually parallel blade surfaces and a generally wedge-shaped tip portion including a run-in blade bevel having an optimum tonal quality size and extending from one of said blade surfaces at an angle corresponding to an angle of attack of the doctor blade relative to said printing surface, and an inclined wedge surface extending from said blade bevel to the other of said blade surfaces, whereby the effective area of said blade bevel would increase from said optimum size through progressive wear of said tip portion during use of said blade to sizes eventuating in progressive degradation of print quality, the improvement comprising in combination the steps of:

preparing a second doctor blade for use in lieu of said conventional doctor blade by providing a doctor blade blank having said blade thickness between said parallel blade surfaces, shaping a marginal portion of said blank into a second blade tip portion, providing said second blade tip portion with a second blade bevel essentially identical to said run-in blade bevel having said optimum tonal quality size and providing said second blade tip portion throughout a useful depth of said second blade tip portion with a constant second blade tip thickness equal to the height of said second blade bevel measured essentially perpendicularly to said useful depth, with said useful depth being made equal to several times said second blade bevel height, whereby the effective area of said second blade bevel remains constantly at said optimum size through progressive wear of said second blade tip portion in the direction of and throughout its useful depth;

applying said second doctor blade to said printing surface at an angle essentially equal to said angle of attack, with said second blade bevel being in contact with said printing form;

applying said ink to said printing surface and printing form;

effecting relative movement between said printing form and second doctor blade whereby said second blade tip portion is caused to wipe excess ink from the printing surface at said optimum size second blade bevel; and continuing said excess ink wiping by continuing said relative movement and advancing said second doctor blade toward said printing form to compensate for wear of said second blade tip portion and to maintain said second doctor blade continuously in contact with said printing form via a second blade bevel maintaining continuously said optimum size throughout said useful depth of said second blade tip portion.

2. A printing method as claimed in claim 1, including the step of:

providing said second blade tip portion with said constant second blade tip thickness throughout a useful depth of one millimeter at a tolerance of plus and minus ten percent.

3. A printing method as claimed in claim 1, including the steps of:

providing a doctor blade holder; and mounting said second doctor blade partially in said doctor blade holder so that the depth of the portion of said doctor blade having said blade thickness between said parallel blade surfaces and being located outside said doctor blade holder and adjacent said second blade tip portion is less than 5.6 times said useful depth of said second blade tip portion.

4. A printing method as claimed in claim 1, including the step of:

providing said second blade tip portion throughout said useful depth with one constant thickness selected in the range of from 40 to 70 microns.

5. A printing method as claimed in claim 4, including the step of:

providing said blade blank with a blade thickness of 150 microns.

6. A printing method as claimed in claim 1, including the step of:

providing said second blade tip portion with a surface extending in a plane with one of said parallel blade surfaces of said blade blank.

7. A printing method as claimed in claim 1, including the step of:

arranging said second blade tip portion relative to the remainder of said second doctor blade so that said second blade tip portion and said second doctor blade remainder have a common longitudinal plane of symmetry.

8. A method as claimed in claim 1, including the steps of:

manufacturing said second doctor blade from steel having a predetermined thickness providing said doctor blade blank having said blade thickness between parallel blade surfaces; and shaping a marginal portion of said steel blank into said second blade tip portion.

9. A method as claimed in claim 1, including the steps of:

manufacturing said second doctor blade from a piece of one solid material having a predetermined thickness providing said doctor blade blank having said blade thickness between parallel blade surfaces; and shaping a marginal portion of said blank into said second blade tip portion.

10. A method of making a doctor blade for wiping excess ink from a printing surface of a printing form in lieu of a conventional doctor blade of a type having a constant blade thickness between two mutually parallel blade surfaces and a generally wedge-shaped tip portion including a run-in blade bevel having an optimum tonal quality size and extending from one of said blade surfaces at an angle corresponding to an angle of attack of the doctor blade relative to said printing surface, and an inclined wedge surface extending from said blade bevel to the other of said blade surfaces, whereby the effective area of said blade bevel would increase from said optimum size through progressive wear of said tip portion during use of said conventional blade to sizes eventuating in progressive degradation of print quality, comprising in combination the steps of:

providing a doctor blade blank having said blade thickness between said parallel blade surfaces;

shaping a marginal portion of said blank into a blade tip portion, providing the latter blade tip portion with a shaped blade bevel essentially identical to said run-in blade bevel having said optimum tonal quality size and providing the latter blade tip portion throughout a useful depth of said latter blade tip portion with a constant blade tip thickness equal to the height of said shaped blade bevel measured essentially perpendicularly to said useful depth, with said useful depth being made equal to several times said shaped blade bevel height whereby the effective area of said shaped blade bevel remains constantly at said optimum size despite progressive wear of said shaped blade tip portion in the direction of and throughout said useful depth during said excess ink wiping.

11. A method as claimed in claim 10, including the step of:

providing said shaped blade tip portion with said constant blade tip thickness throughout a useful depth of one millimeter at a tolerance of plus and minus ten percent.

12. A method as claimd in claim 10, including the steps of:

providing a doctor blade holder; and mounting said made doctor blade partially in said doctor blade holder so that the depth of the portion of said made doctor blade having said blade thickness between said parallel blade surfaces and being located outside said doctor blade holder and adjacent said shaped blade tip portion is less than 5.6 times said useful depth of said shaped blade tip portion.

13. A method as claimed in claim 10, including the step of:

providing said shaped blade tip portion throughout said useful depth with one constant thickness selected in the range of from 40 to 70 microns.

14. A method as claimed in claim 13, including the step of:

providing said blade ink with a blade thickness of 150 microns.

15. A method as claimed in claim 10, including the step of:

providing said shaped blade tip portion with a surface extending in a plane with one of said parallel blade surfaces of said blade blank.

16. A method as claimed in claim 10, including the step of:

arranging said shaped blade tip portion relative to the remainder of said made doctor blade so that said shaped blade tip portion and said made doctor blade remainder have a common longitudinal plane of symmetry.

17. A doctor blade made by the method claimed in claim 10.

18. A method as claimed in claim 10, including the steps of:

making said doctor blade blank of steel having said blade thickness between parallel blade surfaces; and shaping a marginal portion of said steel blank into said second blade tip portion.

19. A doctor blade made by the method claimed in claim 18.

20. A method as claimed in claim 10, including the steps of:

making said doctor blade blank from one piece of solid material having said blade thickness between parallel blade surfaces; and shaping a marginal portion of blank into said second blade tip portion.

21. A doctor blade made by the method claimed in claim 20.

22. A doctor blade for wiping excess ink from a printing surface of a printing form in lieu of a conventional doctor blade of a type having a constant blade thickness between two mutually parallel blade surfaces and a generally wedge-shaped tip portion including a run-in blade bevel having an optimum tonal quality size and extending from one of said blade surfaces at an angle corresponding to an angle of attack of the doctor blade relative to said printing surface, and an inclined wedge surface extending from said blade bevel to the other of said blade surfaces, whereby the effective area of said blade bevel would increase from said optimum size through progressive wear of said tip portion during use of said conventional blade to sizes eventuating in progressive degradation of print quality, comprising in combination:

a doctor blade body having said blade thickness between said parallel blade surfaces, and a marginal blade tip portion adjacent said doctor blade body having a shaped blade bevel essentially identical to said run-in blade bevel with said optimum tonal quality size, and having throughout a useful depth of the latter blade tip portion a constant blade tip thickness equal to the height of said shaped blade bevel measured essentially perpendicularly to said useful depth, with said useful depth being equal to several times said shaped blade bevel height, whereby the effective area of said shaped blade bevel remains constantly at said optimum size despite progressive wear of said marginal blade tip portion in the direction of and throughout said useful depth during said excess ink wiping.

23. A doctor blade as claimed in claim 22, wherein:

said useful depth of the blade tip portion having said constant blade tip thickness is equal to one millimeter at a tolerance of plus and minus ten percent.

24. A doctor blade as claimd in claim 22, wherein:

said constant blade tip thickness has a value selected in the range of from 40 to 70 microns.

25. A doctor blade as claimed in claim 24, wherein:

said blade thickness between said parallel blade surfaces of said doctor blade body is equal to 150 microns.

26. A doctor blade as claimed in claim 22, wherein:

said marginal blade tip portion has a surface extending in a plane with one of said parallel blade surfaces of said doctor blade body.

27. A doctor blade as claimed in claim 22, wherein:

said marginal blade tip portion and said doctor blade body have a common plane of symmetry.

28. A doctor blade as claimed in claim 22, wherein:

said doctor blade body is of steel having said blade thickness between parallel blade surfaces.

29. A doctor blade as claimed in claim 22, wherein:

said doctor blade body is one piece of solid material having said blade thickness between parallel blade surfaces.

30. In a printing apparatus of a type wherein excess ink is wiped from the printing surface of a printing form with a doctor blade having conventionally a given constant blade thickness between two mutually parallel blade surfaces and a generally wedge-shaped tip portion including a run-in blade bevel having an optimum tonal quality and extending from one of said blade surfaces at an angle corresponding to an angle of attack of the doctor blade relative to said printing surface, and an inclined wedge surface extending from said blade bevel to the other of said blade surfaces, whereby the effective area of said blade bevel would increase from said optimum size through progressive wear of said tip portion during use of said blade to sizes eventuating in progressive degradation of print quality, the improvement comprising in combination:

a marginally shaped doctor blade in lieu of said conventional doctor blade, including a doctor blade body having said blade thickness between said parallel blade surfaces, and a marginal blade tip portion adjacent said doctor blade body having a shaped blade bevel essentially to said run-in blade bevel with said optimum tonal quality size, and having throughout a useful depth of the latter blade tip portion a constant blade tip thickness equal to the height of said shaped blade bevel measured essentially perpendicularly to said useful depth, with said useful depth being made equal to several times said shaped blade bevel height, whereby the effective area of said second blade bevel remains constantly at said optimum size despite progressive wear of said marginal blade tip portion in the direction of and throughout said useful depth;

means operatively associated with said marginally shaped doctor blade for applying said marginally shaped doctor blade to said printing surface at an angle essentially equal to said angle of attack and placing said shaped blade bevel into contact with said printing form;

means operatively associated with said printing form for applying said ink to said printing surface and printing form;

means operatively associated with said printing form for effecting relative movement between said printing form and said marginally shaped doctor blade whereby said marginal blade tip portion is caused to wipe excess ink from the printing surface at said optimum size shaped blade bevel; and means operatively associated with said blade applying means for advancing said marginally shaped doctor blade toward said printing form to compensate for wear of said marginal blade tip portion and to maintain said marginally shaped doctor blade continuously in contact with said printing form via a shaped blade bevel maintaining continuously said optimum size throughout said useful depth of said marginal blade tip portion.

31. A printing apparatus as claimed in claim 30, wherein:

said useful depth of the blade tip portion having said constant blade tip thickness is equal to one millimeter at a tolerance of plus and minus ten percent.

32. A printing apparatus as claimed in claim 30, wherein:

said constant blade tip thickness has a value selected in the range of from 40 to 70 microns.

33. A printing apparatus as claimed in claim 32, wherein:

said blade thickness between said parallel blade surfaces of said doctor blade body is equal to 150 microns.

34. A doctor blade as claimed in claim 30, wherein:

said marginal blade tip portion has a surface extending in a plane with one of said parallel blade surfaces of the remainder of said marginally shaped doctor blade.

35. A doctor blade as claimed in claim 30, wherein:

said marginal blade tip portion and the remainder of said marginally shaped doctor blade have a common plane of symmetry.

36. A doctor blade as claimed in claim 30, wherein:

said doctor blade body is of steel having said blade thickness between parallel blade surfaces.

37. A doctor blade as claimed in claim 30, wherein:

said doctor blade body is one piece of solid material having said blade thickness between parallel blade surfaces.

* * * * *